US005136337A

United States Patent [19]

Baruch

[11] Patent Number: 5,136,337

[45] Date of Patent: Aug. 4, 1992

[54] ELECTROSTATOGRAPHIC APPARATUS AND METHOD HAVING A FIXING DWELL TIME EXTENDING DEVICE

[75] Inventor: Susan C. Baruch, Rochester, N.Y.

[73] Assignee: Eastman Kodak Company, Rochester, N.Y.

[21] Appl. No.: 706,486

[22] Filed: May 28, 1991

[51] Int. Cl.[5] ..... G03G 15/20

[52] U.S. Cl. ..... 355/290; 219/216; 355/285; 355/289

[58] Field of Search ..... 219/10.57, 216; 355/282, 285, 289, 290, 309

[56] References Cited

U.S. PATENT DOCUMENTS

| | | | |
|---|---|---|---|
| 4,242,566 | 12/1980 | Scribner | 219/216 |
| 4,682,878 | 7/1987 | Takizawa et al. | 355/309 |
| 4,791,447 | 12/1988 | Jacobs | 355/290 |
| 4,942,420 | 7/1990 | Tomizawa et al. | 355/285 X |
| 4,972,232 | 11/1990 | Hoover et al. | 355/282 X |

*Primary Examiner*—A. T. Grimley
*Assistant Examiner*—P. Stanzione
*Attorney, Agent, or Firm*—Tallam I. Nguti

[57] ABSTRACT

An electrostatographic copier or printer for producing high-quality fixed reflection copy images on paper substrates and high-quality projection copy images on transparency substrates. The copier or printer includes a heat and pressure fixing apparatus having a first fixing nip and a fixing nip dwell time extending device that forms a second fixing nip with the fuser roller thereof.

22 Claims, 2 Drawing Sheets

ELECTROSTATOGRAPHIC APPARATUS AND METHOD HAVING A FIXING DWELL TIME EXTENDING DEVICE

BACKGROUND OF THE INVENTION

1. Field of the Invention

The present invention relates to electrostatographic apparatus such as copiers and printers, and more particularly, to apparatus and method, wherein a fixing device for fixing toner images to a substrate is provided for producing high-quality reflection copy images and high-quality projection copy images.

2. Background Art

Electrostatographic process apparatus which, for example, produce or reproduce toned images on selected substrates such as sheets of paper or transparencies by employing electrostatic charges and toner particles on an insulated photoconductive surface, typically operate through a sequence of currently well known steps. These steps include (1) charging of the insulated photoconductive surface with electrostatic charges, (2) forming a latent image electrostatically on such surface by selectively discharging areas on such surface, (3) developing the electrostatic image so formed with fusable powdery marking or toner particles, (4) transferring the toned image to a suitable substrate such as a sheet of paper or a transparency for fixing thereon by a heat and pressure fixing device, for example in order to form a permanent record copy on such a substrate, and (5) cleaning by removing residual toner and/or other particles from the photoconductive surface in preparation for similarly producing another permanent record copy.

The quality of the permanent record copy so fixed on the substrate depends in significant part on the effectiveness of the fixing device or apparatus. For example, to be effective a heat and pressure fixing apparatus should substantially melt and thus cause the dry powdery marking or toner particles which form an image to flow such that there is little or no perceivable scattering of such particles when the image of the copy is viewed. The degree of melting or flow is dependent, for example, on how long heat and pressure are applied to such particles, and also on how the copy image they form is being viewed.

Copy images on transparencies, for example, are viewed differently from those on sheets of paper. Copy images on a sheet of paper are viewed by reflecting light off of the image side of the sheet of paper. Copy images on a transparency sheet, however, are viewed by shining light from the backside of the sheet, through the sheet and past the image side thereof into a lens and then onto a projection surface or screen. As a consequence, any significant scattering or significant amount of incompletely melted toner particles in the projected image on a transparency sheet will show up as an image defect by causing the light to be scattered away from the lens, thus desaturating the projected image. The same degree of scattering or of incompletely melted toner particles on a reflection sheet-of-paper copy, however, ordinarily may not be perceived as significantly detracting from image quality. Consequently, there is, therefore, a need to melt substantially all the toner particles of a projection copy image, but no need to completely heat and melt toner particles forming reflection copy images on a sheet of paper. In fact, attempting to completely fuse images on a sheet of paper can result in overfusing or overheating of the sheet of paper. Such overheating may undesirably result in other types of image copy defects such as wrinkling and blistering of the sheet of paper.

It is, therefore, difficult and ordinarily cumbersome to attempt to interchangeably produce high-quality reflection and projection image copies on sheets of paper and on sheets of transparencies respectively, using the same fixing apparatus in a copier or printer, for example without undesirably slowing down or reducing the fixing apparatus speed for transparency substrates.

SUMMARY OF THE INVENTION

It is an of the present invention to provide an electrostatographic copier or printer that includes a simple and cost effective fixing device for producing high-quality fixed images on paper and transparency substrates without the above defects.

In accordance with the present invention, an electrostatographic copier or printer is provided and includes a fixing apparatus for producing high-quality reflection and high-quality projection copy images on suitable substrates. The fixing apparatus of the present invention comprises a rotatable heated fuser roller for heating and melting a fusable dry toner image being carried on an image side of a suitable substrate, and a counter rotatable pressure roller. The pressure roller makes contact and forms a first fixing nip that has a predetermined nip width with the fuser roller for moving and pressing the image side of the substrate into heating contact with the fuser roller.

The fixing apparatus of the present invention further comprises control means, and an auxiliary nip-forming means positioned adjacent an exit side of the first fixing nip. The auxiliary nip-forming means under the control means selectively makes contact and forms a second fixing nip with the fuser roller for holding the image side of the substrate into extended heating contact with the fuser roller, as the substrate exits the first fixing nip.

The method of the present invention for producing high-quality fixed projection copies on a transparency substrate includes first passing a transparency substrate carrying a toner image on an image side thereof through the first fixing nip such that the image side is in heat and pressure contact with the fuser roller for a first predetermined fixing dwell time $t_1$. As the transparency substrate exits the first fixing nip, the method next includes passing such substrate through the second fixing nip thereby extending the fixing dwell time by a time $t_2$ in order to cause increased melting of the toner particles. The method for producing high-quality fixed reflection copies on paper substrates includes the steps of selectively moving the auxiliary nip-forming means out of such second nip-forming contact with the fuser roller, and then passing a paper substrate carrying a toner image on an image side thereof through only the first fixing nip such that the image side is in heat and pressure contact with the fuser roller only for that first predetermined dwell time $t_1$.

BRIEF DESCRIPTION OF THE DRAWINGS

In the detailed description of the invention presented below, reference is made to the drawings, in which.

DETAILED DESCRIPTION OF THE PREFERRED EMBODIMENT

Because electrostatographic reproduction apparatus are well known, the present description will be directed in particular to elements forming part of or cooperating more directly with the present invention. Apparatus not specifically shown or described herein are selectable from those known in the prior art.

Figure 1:
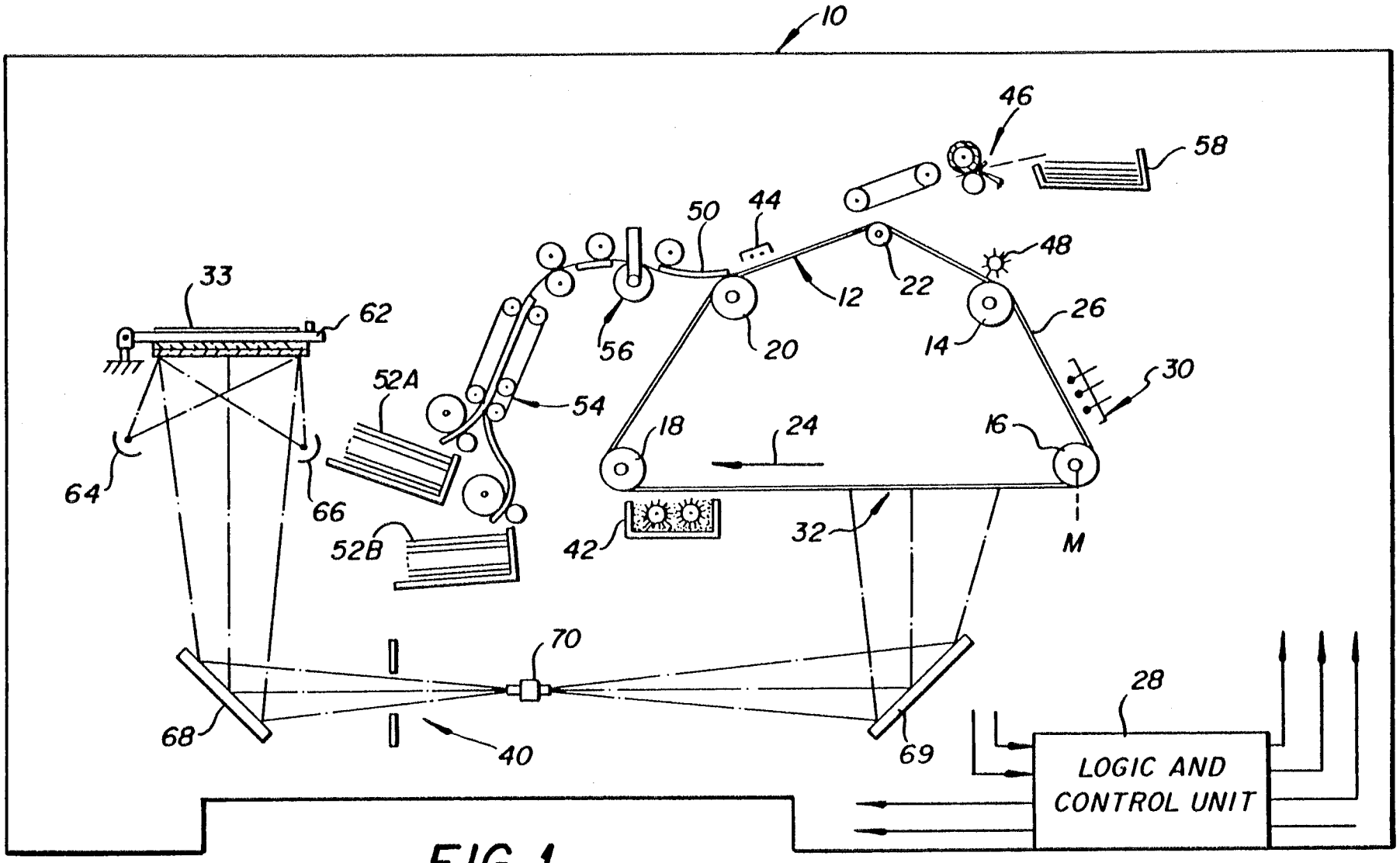
FIG. 1 is a schematic view of an electrostatographic copier or printer of the present invention.

Referring now to FIG. 1, an electrostatographic reproduction apparatus such as a copier or printer is shown schematically as 10. The apparatus 10 is shown as a copier but can also be a printer with appropriate latent image-forming means. As shown, the apparatus 10 includes a photoconductive member 12 which can be a rigid drum or an endless web trained about a plurality of rollers 14–22. One of these rollers, for example, the roller 16, can be a drive roller that is coupled to a drive motor M for moving the member 12 in the direction of the arrow 24. The photoconductive member 12 includes an image-bearing surface 26 that is divisible into a number of image frame areas, for example, six (6) frame areas.

Movement of the member 12 by the roller 16, as above, causes successive image frame areas of its surface 26 to sequentially pass through a series of electrostatographic process stations (to be described below). The operations of these stations are controlled with the help of a logic and control unit (LCU) 28. As is well known, such a control unit 28 may have stored programs that are responsive to input signals for sequentially actuating and deactuating the process stations and other functions of the copier or duplicator 10.

The electrostatographic stations of such copier or duplicator 10 first include a charging station 30 at which the surface 26 of the photoconductive member 12 is sensitized by means such as a corona charger that applies thereto a uniform level of electrostatic charges. The next station is an exposure station 32 at which a latent charge image of an original document 33 is formed on an image frame area of the charged surface 26. Such image formation, in the case of optical copiers and duplicators, is carried out by means of optical imaging apparatus generally designated 40. The optical apparatus 40 may include a platen 62 for holding the original document 33 being imaged, flash lamps 64, 66, a plurality of mirrors 68, 69, and a lens assembly 70. As is well known, such image formation can also be carried out by means of an electronic print head as in the case of a printer using a laser or other electro-optical exposure source.

The electrostatographic process stations of the apparatus 10 further include a development station 42, an image transfer station 44, a fusing station 46 of the present invention, and a cleaning station 48. At the development station 42, means are provided, as is well known, for developing the latent charge image (formed at the exposure station 32) with oppositely charged toner particles. At the transfer station 44, such a toner developed image is transferred with the help of a corona charging device, for example, to a suitable substrate 50 that is fed in registration, to the station 44. As shown, the substrate 50 is fed selectively from a suitable supply storage bins 52A or 52B of such substrates by substrate sheet handling apparatus 54 and through a registration assembly 56. After such image transfer at the station 44, the toner image on the substrate 50 can then be moved to, and fused or fixed onto such substrate or sheet 50 at the fusing station of the present invention which is shown generally as 46. From the fusing or fixing station 46, the fixed copies can be collected, for example, in an output tray 58 or advanced to a suitable finishing apparatus as is well known.

Following the image transfer at transfer station 44, residual toner and other particles remaining on each image frame area of the surface 26 desirably are removed at the cleaning station 48 prior to each such image frame area again reaching and going through the charging station 30.

According to the present invention, the suitable supply 52A of substrates can be sheets of copy paper for making reflection copies of an original image. Such a copy is referred to as a reflection copy because the image copy so formed on the sheet of paper is viewed by reflecting light off of the image side of such a sheet of paper. On the other hand, the suitable supply 52B of substrates is preferably sheets of transparency material for making projection copies of an original image. This latter copy is referred to as a projection copy image, because the image so made on the sheet of transparency is viewed by shining light from the back or non-image side of the transparency sheet, through the sheet and past the image side thereof, through a lens and onto a suitable projection screen or background onto which such image is thus projected.

The electrostatographic copier or printer 10 of the present invention is particularly suitable for producing high-quality reflection copy images on substrates of paper sheets, and high-quality projection copy images on substrates of transparency sheets. For doing so, the copier or printer 10 includes the photoconductive member 12 and process stations as described above for forming, developing and transferring a toner image onto the desired suitable substrate 50 which can be a sheet of paper or a transparency. More importantly, the copier or printer 10 includes the logic and control unit 28 and the heat and pressure fusing or fixing station 46 of the present invention for providing a predetermined fixing dwell time, as well as means for selectively increasing such dwell time for heating and melting the toner image on a substrate 50.

Figure 2:
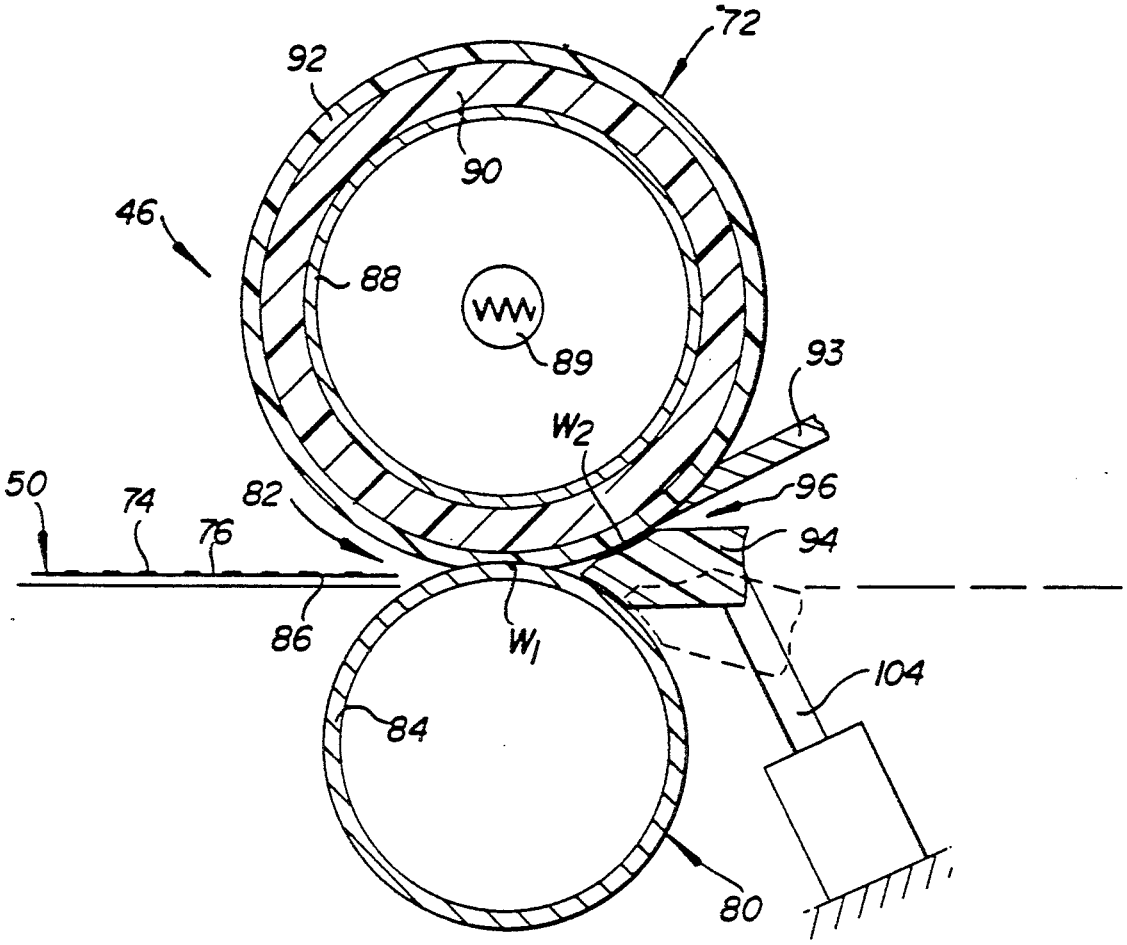
FIG. 2 is a section of the fixing apparatus of the present invention including the dwell time extending device made in accordance with the invention.
Figure 3:
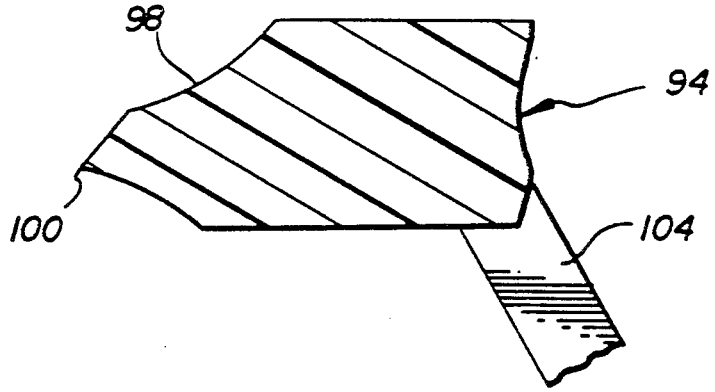
FIG. 3 is an enlarged view of a portion of the apparatus shown in FIG. 2 and illustrating additional details of the second nip-forming method of the dwell time extending device of the present invention.

Referring now to FIGS. 2 and 3, the fixing apparatus 46 comprises a rotatable heated fuser roller 72 for heating and melting a fusable dry toner image 74 being carried on the image side 76 of a suitable substrate 50. As described above, the substrate 50 can be a paper substrate from the supply 52A thereof, or a transparency substrate from the supply 52B thereof. The fixing apparatus 46 also comprises a counter member such as a rotatable pressure roller 80 which makes contact and forms a first fixing nip 82 having a predetermined nip width $W_1$ with the fuser roller 72 for moving the substrate 50 therethrough. Moving the substrate, as such, presses the image side 76 of such substrate into heating contact with the fuser roller 72.

As shown, the pressure roller 80 may include a rigid usually metallic shell 84 with a desired surface finish thereto for directly contacting the backside 86 of the substrate 50. On the other hand, the fuser roller 72 includes a rigid, hollow core shown as 88 that is heat conductive. A lamp 89 may, for example, provide required heat in the case of an internally heated fuser roller. The fuser roller 72 further includes a compliant base cushion layer 90 that may be made of an elastomeric material. The layer 90, as shown, overlays the core 88, and may itself be overlaid by a compliant outer layer 92 consisting of an elastomeric material having a desired finish thereto.

The rigid shell 84 of the pressure roller 80 is spring loaded controllably against the fuser roller 72 by suitable conventional spring means (not shown) so as to result in the desired predetermined nip width $W_1$ of the first fixing nip 82 through resilient deformation of the fuser roller. In accordance with the present invention, the predetermined nip width $W_1$ of the fixing nip 82 should be such that at a given and desired run speed of the fixing apparatus 46, it will result in a first fixing nip dwell time $t_1$ for a substrate being moved therethrough. The dwell time $t_1$ should be such time as is sufficient under given other conditions of the fixing apparatus 46 for producing high-quality fixed reflection copy images on a paper substrate. To assist removal of such a substrate from the fuser roller 72, the apparatus 46 includes a first skive 93 for peeling the substrate 50 from the fuser roller 72.

The fixing apparatus 46 further comprises a dwell time extending device in the form of an auxiliary nip-forming means 94 that is positioned adjacent the exit side of the first fixing nip 82. Thereat, the auxiliary nip-forming means 94 can make contact, and form a second or extension fixing nip 96, with the fuser roller 72 for receiving and holding the image side 76 of a substrate 50 into extended heating contact with the heated fuser roller 72 as such substrate exits the first fixing nip 82. The means 94 as shown is substantially stationary or fixed in position relative to the fuser roller 72 when in such extension nip formation.

The auxiliary nip-forming means 94 can, for example, be a second skiving device that is movable into and out of such second fixing nip-forming contact with the fuser roller 72. The means or skiving device 94 includes a nip-forming section 98 for directly contacting the fuser roller 72 to form the second fixing nip 96 with such fuser roller 72. The nip-forming section 98, as such, preferably has a concave outer surface thereto, and a radius of curvature that is substantially the same as that of the outer surface of the fuser roller 72. The auxiliary nip-forming means or skive device 94 further may include a skiving section 100 (FIG. 3) for peeling and separating an exiting substrate 50 from the pressure roller 80 while the device 94 is in either of its two positions.

Referring now to FIG. 3, the nip-forming section 98 of the means 94 should be wide enough to produce a desirable nip width $W_2$. The nip width $W_2$ should be such that at a given and desired run speed of the fixing apparatus 46, it will result in a second fixing nip dwell time $t_2$. The dwell time $t_2$ should be such as to extend and make the maximum fixing dwell time ($t_1+t_2$ for a substrate that is being moved through the first and second fixing nips 82, 96. The extended maximum fixing dwell time ($t_1+t_2$) should be such time as is sufficient under given other conditions of the fixing apparatus 46 for resulting in increased melting of the toner particles forming the images, and therefore for producing high-quality fixed projection copy images on a transparency substrate. Preferably, the additional dwell time $t_2$ of a transparency substrate through the second fixing nip 96 should be less than the dwell time $t_1$ of such substrate through the first fixing nip 82. The preferred durations of dwell times $t_1$, $t_2$ may be determined empirically for each type of copy machine.

The dwell time extending device or auxiliary nip-forming means 94 is desirably connected to means such as a solenoid assembly 104, for moving such means 94 into and out of nip-forming contact or position with the heated fuser roller 72. Additionally, the solenoid assembly 104 is desirably connected to the logic and control unit (LCU) 28 so that the means or device 94 can be selectively moved into and out of nip-forming contact with the heated fuser roller 72 depending on whether a paper or a transparency substrate is being used. Accordingly, the means or device 94 will be moved out of contact with the fuser roller 72 when it is desired to produce high-quality reflection copy images on a paper substrate, and it will be moved into a second fixing nip-forming contact therewith when it is desired to produce high-quality projection copy images on a transparency substrate. An operator, for example, may input via a button or an operator control panel (OCP) that a transparency substrate copying operation is selected. Alternatively, a photosensor (PS) may be provided to sense whether a particular substrate being fed is a transparency. Signals from the button or sensor can then be acted upon appropriately by the LCU28 for selecting and controlling the copy machine.

As described above, the fixing dwell time for high-quality reflection copies on paper substrates will be $t_1$since such copies are fixed through only the first fixing nip 82. On the other hand, the fixing dwell time for each transparency substrate will be extended beyond $t_1$, to a maximum time of $t_1+t_2$ by moving each such transparency substrate through both the first and second fixing nips 82 and 96, respectively.

The method of the present invention for producing high-quality reflection copies accordingly includes the steps of moving the means 94 out of second nip-forming contact with the fuser roller 72, and then passing the image-carrying paper substrate through only the first fixing nip 82 for a fixing dwell time $t_1$. The method for producing high-quality projection copies then accordingly comprises the steps of passing each transparency substrate that is carrying a toner image on an image side thereof through the first fixing nip 82 such that the image side is in heat and pressure contact with the fuser roller 72 for the predetermined dwell time $t_1$. Then, as such transparency substrate is exiting the first fixing nip 82, passing such transparency substrate through the second fixing nip 96 for a dwell time $t_2$ thereby significantly extending the dwell time of the heated fuser roller for heating the toner image on the transparency substrate. Such extended heating of toner images on the transparency substrate causes increased melting of the toner particles forming such images, as compared, for example, to the melting of similar toner particles forming images on paper substrates.

As disclosed above, the auxiliary nip-forming means 94 is shown as a skiving device 94 that, when in nip-forming contact with the fuser roller 72, is stationary relative thereto. However, it is understood that such means 94 could be any suitable member, including another roller, for forming the second fixing nip 96 with the single fuser roller 72. As shown, the single fuser roller 72 is movable rotatably through the first fixing nip 82 and through the second fixing nip 96 against the stationary nip-forming section 98 of the member 94. Because of the stationary condition of the nip-forming section 98, it is preferable that surface friction between the outer surface of the fuser roller 72 and the image side 76 of a transparency substrate which is being passed through the second fixing nip 96, should be significantly greater than such friction between the surface of the nip-forming section 98 and the backside 86 of such substrate. To ensure such reduced friction associated with the surface of the nip-forming section 98, such surface of the nip-forming section 98 that contacts the backside 86 should be coated with a friction-reducing material such as a synthetic flourine-containing resin, for example Teflon (a trademark of the DuPont Co.).

As can be seen, the present invention provides an electrostatographic copier or printer that includes a simple and relatively less expensive fusing station 46 for selectively producing high-quality fixed reflection copy images on paper substrates and high-quality projection copy images on transparency substrates. The invention has been described with particular reference to the production of high quality copies on paper and on transparency substrates, but those skilled in the art will understand it to be equally applicable (a) to the production of high quality matte and glossy copies on sheets of paper, for example, or (b) the production of images using different types of toners, for example colored toners. Additionally, whereas only a single nip extending device 94 is shown, it is understood that a plurality of such nip extending devices can equally be used. Each such device will form its own auxiliary nip, with the fuser roller 72, having a desired nip width for providing a desired additional dwell time to the maximum dwell time of upstream nip forming devices. As pointed out above, each such device can also be rotatable such as a roller. Each device, of course, is connected appropriately by means to the LCU28 and can be selectively articulated into and out of contact with the fuser roller 72 for providing as long a desired maximum dwell time as called for by the fixing requirements of a particular image and substrate being processed.

The invention has been described in detail with particular reference to a presently preferred embodiment, but it will be understood that variations and modifications can be effected within the spirit and scope of the invention.

What is claimed is:

1. A fixing apparatus for fixing toner images on a substrate in an electrostatographic reproduction apparatus, the fixing apparatus comprising:

(a) only one rotatable heated fuser roller for heating and melting a toner image being carried on an image side of the substrate;

(b) a counter member making contact and forming with said fuser roller a first fixing nip having a predetermined nip width $W_1$ for pressing said image side of said substrate into heating contact with said fuser roller; and (c) auxiliary nip-forming means positioned immediately adjacent an exit side of said first fixing nip and forming a second fixing nip with said fuser roller, for holding the image side of the substrate into continued pressing contact with said fuser roller as the substrate exits said first fixing nip.

2. The fixing apparatus of claim 1 wherein said predetermined nip width $W_1$ of said first fixing nip at a given fixing apparatus run speed results in a first fixing nip dwell time $t_1$ sufficient for producing a high-quality fixed reflection copy image on a paper substrate.

3. The fixing apparatus of claim 1 wherein said auxiliary nip-forming means is movable into and out of said second fixing nip-forming contact with said fuser roller in response to signals related to first and second types of substrates, respectively to be worked on by said fixing apparatus.

4. The fixing apparatus of claim 1 wherein said auxiliary nip-forming means includes a nip-forming section that is concave and has a radius of curvature substantially the same as that of the outer surface of said fuser roller, and that is mounted such that it receives and routes the substrate in pressing contact against said fuser roller through said auxiliary nip.

5. The fixing apparatus of claim 1 wherein said auxiliary nip-forming means is substantially stationary relative to said fuser roller.

6. The fixing apparatus of claim 2 wherein said second fixing nip provides a second fixing nip dwell time $t_2$ at said given fixing apparatus run speed such that a maximum fixing dwell time of the fixing apparatus is $t_1+t_2$ and is sufficient for substantially increasing the melting of toner images and thereby producing a high-quality fixed projection copy image on a transparency substrate.

7. The fixing apparatus of claim 3 wherein said auxiliary nip-forming means is selectively movable out of contact with said fuser roller when images are being fixed on a paper substrate, and into second nip-forming position with said fuser roller when images are being fixed on a transparency substrate.

8. The fixing apparatus of claim 4 wherein said counter member is a rotatable pressure roller and said auxiliary nip-forming means includes a skiving section for peeling and separating a substrate from said pressure roller, as such substrate is exiting said first fixing nip.

9. The fixing apparatus of claim 4 wherein said auxiliary nip-forming means is substantially stationary relative to said fuser roller.

10. The fixing apparatus of claim 9 wherein surface friction between the outer surface of said fuser roller and the image side of said substrate is significantly greater than such friction between said concave nip-forming section of said auxiliary nip-forming means and the backside of said substrate.

11. The fixing apparatus of claim 10 wherein the surface of said concave nip-forming section in contact with said backside of the substrate is coated with a friction-reducing material.

12. The fixing apparatus of claim 11 wherein said friction-reducing material is Teflon.

13. The fixing apparatus of claim 6 wherein said second fixing nip dwell time $t_2$ is less than said first fixing nip dwell time $t_1$.

14. The fixing apparatus of claim 1 wherein said auxiliary nip-forming means is movable into and out of said second fixing nip-forming position with said fuser roller in response to signals related to first and second required maximum fixing dwell times for producing matte and flossy fixed copies respectively from said fixing apparatus.

15. The fixing apparatus of claim 1 wherein said auxiliary nip-forming means is movable into and out of said second fixing nip-forming position with said fuser roller in response to signals related to first and second types of toner respectively forming images being fixed by said fixing apparatus.

16. In an electrostatographic reproduction apparatus having only one heated fuser roller and a pressure roller forming a first fixing nip suitable for producing a high-quality fixed reflection copy image on a paper substrate, a method for producing a high-quality fixed projection copy image on a transparency substrate, the method comprising the steps of:

(a) first passing a transparency substrate carrying a toner image on an image side thereof through the first fixing nip formed by the heated fuser roller and the pressure roller such that the image side of the transparency substrate is in heat and pressure contact with the fuser roller for a predetermined dwell time; and (b) as the transparency substrate exits said first fixing nip, next holding the transparency in continued heat and pressure contact with the fuser roller by passing such substrate through a second fixing nip formed by said fuser roller and an auxiliary nip-forming means positioned immediately adjacent the exit side of said first fixing nip thereby significantly extending the dwell time of said heated fuser roller for heating the toner image on the transparency substrate in order to cause increased melting of such a toner image.

17. An electrostatographic reproduction apparatus for producing high-quality reflection copies on paper substrates and high-quality projection copies on transparency substrates, the reproduction apparatus comprising:

(a) means including a photoconductive member for forming a latent electrostatic image of an original on said photoconductor;

(b) means for developing the latent electrostatic image with toner particles;

(c) means for feeding a suitable substrate into an image-transfer relationship with said photoconductor wherein the substrate is a sheet of paper or a transparency sheet;

(d) means for transferring the toner developed image from said photoconductor onto said suitable substrate;

(e) a fixing apparatus for fixing said toner image onto said substrate to form a copy of the original image, said fixing apparatus including:

(i) only one rotatable heated fuser roller for heating and melting the toner particles forming the image being carried on the suitable substrate;

(ii) a counter-rotatable pressure roller making contact with and forming a first fixing nip having a predetermined nip width with said fuser roller for moving said substrate and pressing the image side thereof into heating contact with said fuser roller; and (iii) auxiliary nip-forming means positioned immediately adjacent an exit side of said first fixing nip, said auxiliary nip-forming means making contact with and forming a second fixing nip with said fuser roller for holding a portion of the image side of said substrate into extended continued pressing contact with said fuser roller after such portion has exited said first fixing nip.

18. The reproduction apparatus of claim 17 wherein said auxiliary nip-forming means is movable into and out of said second fixing nip-forming contact with said fuser roller.

19. The reproduction apparatus of claim 18 further including control means for selectively moving said auxiliary nip-forming means into and out of said second fixing nip-forming contact with said fuser roller.

20. The reproduction apparatus of claim 19 wherein said control means is responsive to a signal relating to a type of substrate to be worked upon by said fixing apparatus and in response thereto selectively moves said auxiliary nip-forming means into said second fixing nip-forming contact with said fuser roller when the receiving substrate fed by said substrate feeding means is a transparency sheet, and out of said second fixing nip-forming contact when the receiving substrate so fed is a sheet of paper.

21. In an electrostatographic reproduction apparatus, a fixing apparatus for producing high-quality fixed image copies on a paper substrate and on a transparency substrate, the fixing apparatus including:

(a) a rotatable heated fuser roller for heating and a melting a toner particle image being carried on a substrate;

(b) a pressure roller making contact with and forming a first fixing nip with said fuser roller for moving and pressing the image side of said substrate into heating contact with said fuser roller;

(c) a first skiving device positioned downstream of said first fixing nip relative to the direction of movement of said substrate for separating said substrate from said fuser roller; and (d) a second skiving device positioned between said first skiving device and said first fixing nip for separating said substrate from said pressure roller, said second skiving device including means for forming a second fixing nip against said fuser roller and means for directing and holding said substrate as separated from the pressure roller into significant extended heating contact through said second fixing nip with said heated fuser roller.

22. The fixing apparatus of claim 21 wherein said means for forming said second fixing nip with said fuser roller comprises a concave nip-forming section, having a radius of curvature substantially equal to the radius of the outer surface of said fuser roller.

* * * * *